United States Patent [19]

Hack

[11] 3,940,521

[45] Feb. 24, 1976

[54] CHRISTMAS TREE ORNAMENT

[75] Inventor: Siegfried Hack, Toronto, Canada

[73] Assignee: The Raymond Lee Organization, Inc., a part interest

[22] Filed: Nov. 5, 1974

[21] Appl. No.: 520,988

[52] U.S. Cl. ..... 428/7; 46/30; 240/10 T

[51] Int. Cl.[2] ..... A47G 33/08

[58] Field of Search ..... 161/12, 16; 46/30; 240/10 T, 100, 138; 428/7, 11

[56] References Cited

UNITED STATES PATENTS

| | | | |
|---|---|---|---|
| 2,078,370 | 4/1937 | Corbett | 240/138 |
| 2,095,648 | 10/1937 | Oftedahl | 240/10 T |
| 2,199,434 | 5/1940 | Koonz | 240/10 T |
| 2,512,129 | 6/1950 | Appleby | 240/10 T |

FOREIGN PATENTS OR APPLICATIONS

| | | | |
|---|---|---|---|
| 986,606 | 3/1965 | United Kingdom | 240/10 T |

*Primary Examiner*—William E. Schulz

[57] ABSTRACT

An ornament which can be hung as a decoration from a Christmas tree or wall with a lamp bulb disposed inside and secured to the tree or wall. The ornament is a hollow decorated plastic member having a bulb receiving opening and clamping means secured to the inside of the member adjacent the opening to detachably receive and hold the bulb.

2 Claims, 5 Drawing Figures

FIG. 1
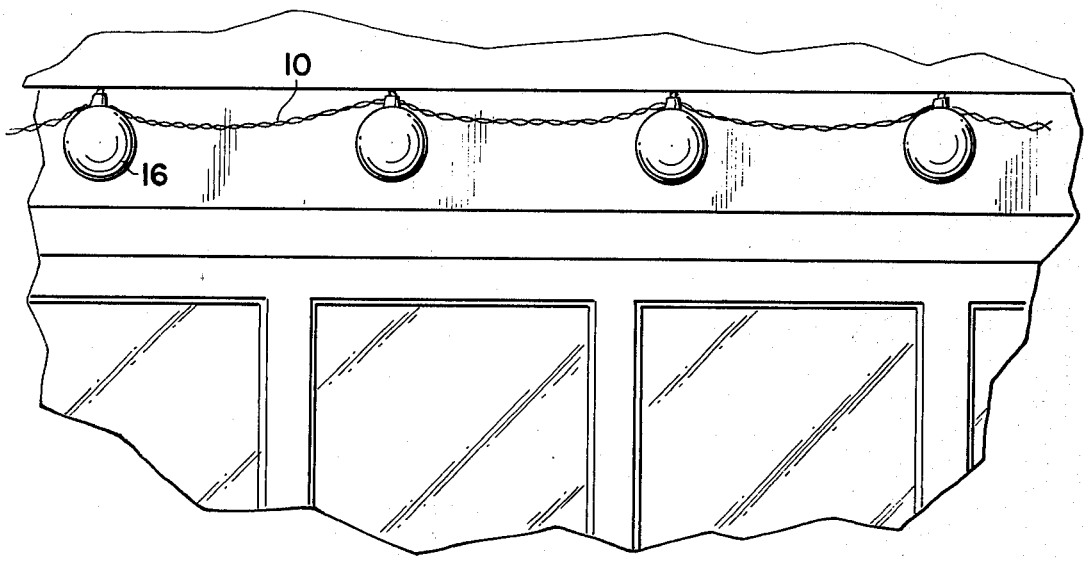
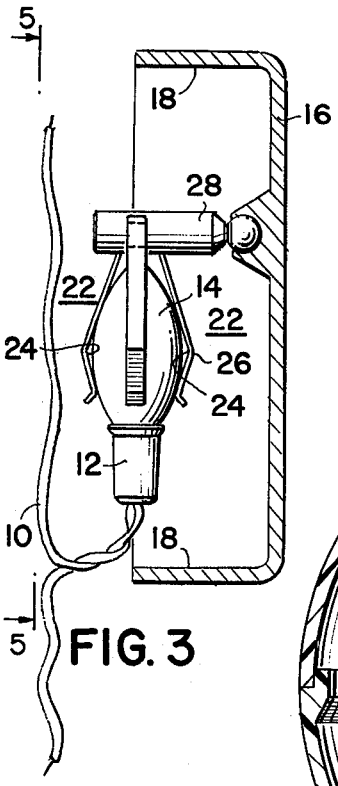
FIG. 3
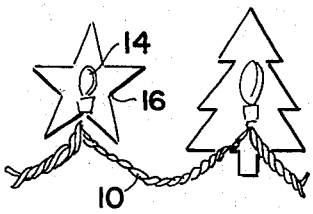
FIG. 4
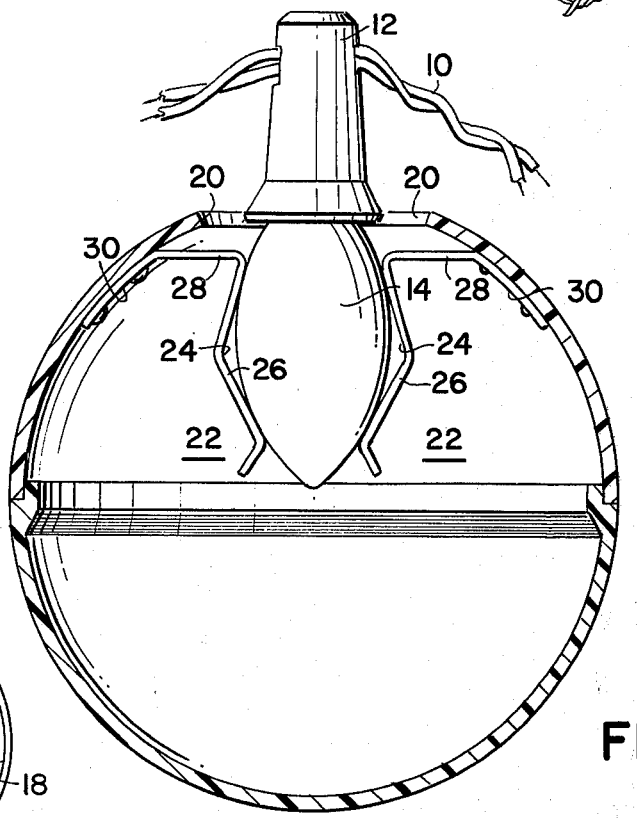
FIG. 2
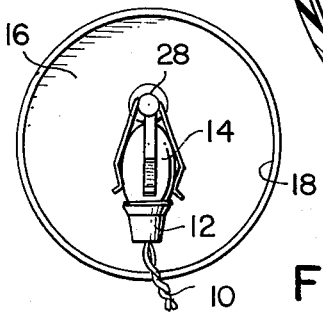
FIG. 5

CHRISTMAS TREE ORNAMENT

SUMMARY OF THE INVENTION

This invention is directed toward an ornament for Christmas trees, building walls and the like, particularly trees or walls which support lamp bulbs thereon.

The ornament takes the form of a hollow decorated plastic member having a bulb receiving opening. Clamping means secured to the inside of the member adjacent the opening detachably receive and hold the bulb.

The member is a pleasing decoration when the bulb is dark and produces an enhanced decorative effect when the bulb is lit.

BRIEF DESCRIPTION OF THE DRAWINGS

In the drawings:

FIG. 1 shows the invention in use;

FIG. 2 is an anlarged cross section of one embodiment of the invention;

FIG. 3 is an enlarged cross section of another embodiment of the invention;

FIG. 4 illustrates another use of the invention; and

FIG. 5 is a view taken along line 5-5 in FIG. 3.

DETAILED DESCRIPTION OF PREFERRED EMBODIMENTS

Referring now to FIGS. 1, 2 and 4, wiring 10 carries spaced lamp sockets 12 with lamp bulbs 14 disposed therein. The wiring can be disposed on a Christmas tree or can be hung adjacent or on a wall or can be disposed or hung in many other ways.

A hollow decorated plastic member 16 which can be generally rectangular with a side opening 20, or generally spherical with an opening 20, or star or tree shaped with a like opening contains a bulb receiving clip disposed inside adjacent the opening. The bulb is detachably dispoed inside the clip. Since the clip is secured to the member, the bulb is held in place.

The clip employs four equidistantly disposed leaf spring elements 22 which extend generally in the direction of the longitudinal axis of the bulb. Each element in vertical cross section has a central region 24 defining a shallow V, the apex 26 of the region pointing away from the bulb, the bulb resting within the central regions.

Extensions 28 at one end of each region extend outward from the bulb at right angles to the longitudinal axis and can terminate in flat extensions 30 secured to the inside wall of the member as shown in detail in FIG. 2.

Alternatively, as shown in FIGS. 3 and 5, the top ends of elements 22 can be secured to a horizontal cylinder 46 having one end formed into a rounded tip 40. This tip fits pivotably into spherical recess 42 in an enlarged region 44 of the inside wall. Cylinder 46 can be pivoted about tip 40 to position bulb 14 as desired.

The bulb is thus held detachably in position in the member and acts as a support for the member.

While the invention has been described with detailed reference to the drawings, the protection sought is to be limited only by the terms of the claims which follow.

I claim:

1. An ornament for Christmas trees, walls or the like which is to be detachably secured to a lamp bulb disposed on the tree, said ornament comprising:

a hollow decorated plastic member having a bulb receiving opening and an inside wall having an enlarged region; said region having a recess;

a horizontal cylinder having a tip at one end, said cylinder being disposed within the member with said tip being pivotally disposed in the recess; and elongated clamping means secured to the other end of the cylinder within said member adjacent said opening to detachably receive and hold said lamp bulb, said means extending at right angles to said cylinder.

2. The ornament of claim 1 wherein said means includes a plurality of spaced elongated leaf spring elements, each element in vertical cross section having a central region in the shape of a shallow V, the vertex of the V pointing outward from the bulb, the bulb resting within the central regions.

* * * * *